US006739387B1

(12) United States Patent
Ren

(10) Patent No.: US 6,739,387 B1
(45) Date of Patent: May 25, 2004

(54) HEAT EXCHANGER TUBING AND HEAT EXCHANGER ASSEMBLY USING SAID TUBING

(75) Inventor: Baolute Ren, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/374,890

(22) Filed: Feb. 25, 2003

(51) Int. Cl.[7] ..... F28D 7/06

(52) U.S. Cl. ..... 165/176; 165/177; 165/153; 138/38

(58) Field of Search ..... 165/177, 168, 165/174, 153, 176; 138/38; 29/890.053

(56) References Cited

U.S. PATENT DOCUMENTS

| | | | | | |
|---|---|---|---|---|---|
| 1,622,664 | A | * | 3/1927 | Murray et al. | 138/117 |
| 2,151,540 | A | * | 3/1939 | Varga | 138/117 |
| 2,911,199 | A | * | 11/1959 | Huet | 165/165 |
| 4,766,953 | A | * | 8/1988 | Grieb et al. | 165/177 |
| 5,553,377 | A | * | 9/1996 | Hirano et al. | 29/890.053 |
| 6,357,522 | B2 | * | 3/2002 | Dienhart et al. | 165/183 |
| 6,622,785 | B2 | * | 9/2003 | Haegele et al. | 165/177 |

FOREIGN PATENT DOCUMENTS

| | | | | |
|---|---|---|---|---|
| JP | 1-312390 A | * | 12/1989 | 165/177 |
| JP | 1-312391 A | * | 12/1989 | 165/177 |
| WO | WO 02/16834 A2 | | 2/2002 | |

* cited by examiner

*Primary Examiner*—Terrell McKinnon
(74) *Attorney, Agent, or Firm*—David W. Pearce-Smith

(57) ABSTRACT

A heat exchanger tubing has one or more channels formed therein for fluid flow, with channel walls between the channels having openings extending between two opposing surfaces of the tubing. The channel walls are angled with respect to the opposing surfaces to increase the surface area of the openings. The tubing is tilted with respect to the headers in a heat exchanger assembly so that the openings in the tubing align with the direction of airflow passing over the heat exchanger. A heat exchanger assembly employing the tubing is effective without conventional fin stock, thus reducing the cost and manufacturing time when making the heat exchanger assemblies but without sacrificing heat exchange capability.

22 Claims, 3 Drawing Sheets

HEAT EXCHANGER TUBING AND HEAT EXCHANGER ASSEMBLY USING SAID TUBING

FIELD OF THE INVENTION

The present invention is directed to heat exchanger tubing for heat exchanger construction, and particularly to multivoid tubing that can be used in a heat exchanger without the need for fin stock.

BACKGROUND ART

In the prior art, heat exchanger design typically includes a series of fins and tubes. The tubes act as conduits for fluid flow whereby heat from an operating device such as an air conditioner is brought to the heat exchanger. The fins are attached to the tubes and allow the transfer of heat from the tubes to the surrounding media, typically air.

While heat exchangers are used in a vast array of applications, one popular use is in the automotive field, wherein condensers as heat exchangers are used in conjunction with automotive air conditioning. These types of heat exchangers are made using essentially two different designs. A first design uses round tubing and bare fins that are mechanically attached to the round tubes by first lacing the tubes into holes punched in the fins, and then expanding the tubes to ensure that the tube's outer surface is in close contact with the fins.

A second design uses a flat tubing having a plurality of channels in the tubing, commonly referred to as multivoid tubing. Referring to FIG. 1, an exemplary tubing is designated by the reference numeral 10, and includes a number of parallel flow channels 3 that are separated by a web(s) or wall(s) 5 that are aligned along the longitude of the tubing or generally perpendicular to the opposing surfaces 7 and 9. The cross section of the flow channels can vary, e.g., circular, oval, square, rectangular, of other regular or irregular shapes. The inner walls of the channels can be smooth or rough. In making these types of heat exchangers, the tubes are joined to corrugated fins using a brazing process. Typically, these types of multivoid tubing are about 10–25 mm in width, about 1–2 mm in height, and around 500–750 mm in length.

FIG. 2 shows a partial schematic perspective view of a typical installation of the tubing 10 in a heat exchanger assembly 20. The tubing 10 is attached at one end to a header 21 (attachment to an opposing header is not shown), and separated from an adjacent tubing 10 by fin stock 23. A series of tubes separated by fin stock form the entire heat exchanger. Fluid flows from the header 21 and through the channels 3 in the tubing 10 to the other header. The fin stock 23 assists in heat exchange via its close or brazed contact with the tubing, and high surface area. The tubing 10, fin stock 23 and headers 21 form a plane that is generally perpendicular to the direction of air or other fluid flowing past the assembly 20 as represented by arrow "A".

Another proposed design is disclosed in WO 02/16834 to Moser et al. In one aspect of the designs disclosed in this publication, a finless construction is shown wherein multivoid tubes are formed into a serpentine shape. While this shape increases the surface area of the tube to enhance heat transfer, it also intensifies air turbulence passing over the tubing. This creates an unwanted pressure drop across the tubing, and compromises the enhanced heat transfer created by the tubing configuration.

In light of the disadvantages associated with prior art tubing and heat exchanger assembly design, a need exists for improved tubing design, as well as improved heat exchanger assembly design. The present invention is a response to this need by providing an improved tubing design that overcomes the deficiencies of prior art designs, and allows for the assembly of a heat exchanger at reduced costs and manufacturing times.

SUMMARY OF THE INVENTION

It is a first object of the invention to provide an improved heat exchanger tubing design.

Another object of the invention is a heat exchanger that uses a series of the inventive tubing without fin stock.

A still further object of the invention is heat exchanger tubing that offers a simpler heat exchanger construction while maintaining a high degree of heat exchange.

Other objects and advantages of the invention will become apparent as the description thereof proceeds.

In satisfaction of the foregoing objects and advantages, the present invention is an improvement in heat exchanger tubing that employs a number of channels for fluid flow, wherein adjacent channels are separated by an inner wall that extends between top and bottom surfaces of the tubing. According to the invention, the inner wall separating the channels of the tubing is angled with respect to the top and bottom surfaces of the tubing. In addition, a number of passageways or through openings are provided in the tubing, each opening extending between opposing surfaces and within a given inner wall of the tubing.

By using this design, the tubing can be used in a heat exchanger assembly but does not require the presence of fin stock in contact with the tubing; the tubing can be arranged in a spaced apart parallel fashion between headers. When used in a heat exchanger assembly, the tubing is tilted with respect to the direction of air flow passing through the assembly so that the openings in the inner channel walls are aligned with the air flow direction. This enhances the heat exchange characteristic of the assembly and allows the air to pass through the assembly with less of a pressure drop.

The openings in the inner channel walls can be arranged along the longitude or transverse dimension in any number of ways, e.g., each opening aligned transversely and spaced apart along the length of the tube in set distances. Alternatively, only some openings can be aligned in the transverse direction, and the longitudinal spacing of the openings could vary among channel walls.

The tubing can be any type of multivoid tubing, but is preferably an extruded tubing made from non-ferrous metal alloys that are typically used in heat exchange applications.

The angle of the inner wall as measured from one of the opposing surfaces can range from 2 to 88 degrees with more preferred ranges including 10–60 degrees, and 20–40 degrees.

The openings in the inner channel walls can have regular or irregular cross sectional shapes. The surfaces of the openings in the inner channel can be smooth or include fins or other surface area-increasing enhancements. The tubing itself can be formed into the conventional flat tubing shape, or have an irregular shape for use in special applications. The tubing can also be formed such that the top and bottom walls form surfaces that have a shape that is not flat, e.g., undulating, stepped or the like. The tubing channels can be made with a variety of cross section shapes and surfaces as is used in conventional multivoid tubing.

BRIEF DESCRIPTION OF THE DRAWINGS

Reference is now made to the drawings of the invention wherein.

DESCRIPTION OF THE PREFERRED EMBODIMENTS

The present invention provides significant advantages over prior art heat exchanger tubing. In one aspect, the inventive tubing can be employed in a heat exchanger assembly without the fin stock that is customarily used. By doing so, the assembly processes wherein the tubing is brazed or otherwise attached to the fin stock is eliminated, thus reducing the time and cost for assembly manufacture. The tubing also offers flexibility in terms of controlling heat exchange since the through openings in the channel walls can be varied along the longitudinal and transverse directions of the tubing. Applications having a higher heat transfer requirement may use a greater number of openings or enlarged openings in the channel walls for increased heat exchange, whereas lighter duty application can use a lesser number of openings. Alternatively, the angulation of the walls may be altered to increase the opening length and improve heat transfer if need be.

Figure 3:
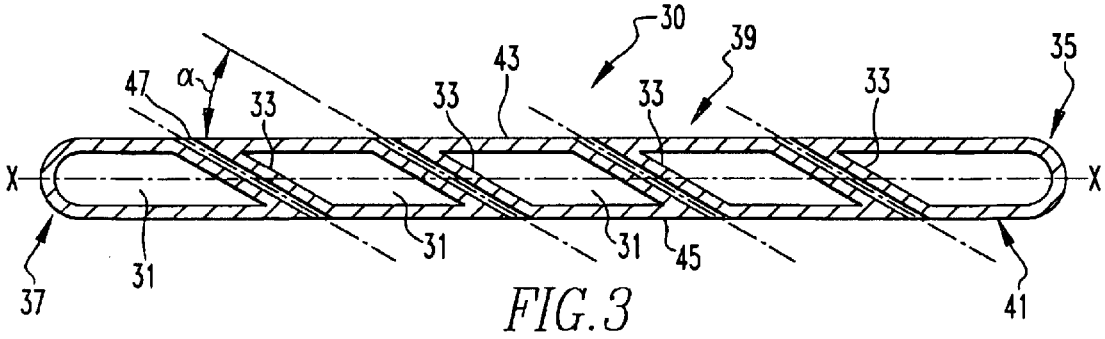
FIG. 3 is a cross section view of one embodiment of the inventive heat exchanger tubing.

Referring now to FIG. 3, one embodiment of the inventive tubing is designated by reference numeral 30. The tubing is a multivoid type tubing having a plurality of channels 31 separated by channel walls 33. The tubing also has opposing ends 35 and 37, and opposing walls 39 and 41, with wall surfaces 43 and 45, respectively.

Each of the channel walls 33 is angled with respect to the opposing wall surfaces 43 and 45. As measured from a surface 43 of the wall 39, the angle is represented by $\alpha$, even though the angle can be measured using other criterion such as a plane coincident with the transverse axis "X", or even a plane perpendicular to this axis. The angle $\alpha$ can vary from the horizontal, e.g., have a range of 2 to 88 degrees. A more preferred range is 10–60 degrees, and even more preferably 20–40 degrees, with a target range of around 25–35 degrees.

In conjunction with the angled channel walls is the presence of open-ended passages or openings 47 extending through the walls 33 and between the surfaces 43 and 45 of the opposing walls 39 and 41. The FIG. 3 embodiment shows an opening 47 in each of the angled channel walls 33, although, depending on the tubing application, the openings 47 could be made in less than all of the inner walls 33.

The opening 47 in a given channel wall 33 increases the surface area of the tubing 30, and contributes to improved heat transfer characteristics. The angling of the channel walls increases the length of the opening 47, thus creating more heat exchange surface area. The heat exchange characteristics of the tubing can be altered by changing the opening frequency and size/shape. The openings 47 can have different cross sectional shapes such as rectangular, square, hexagonal, or any other polygonal shape. Alternatively, the shape could be circular, oval, or other type shapes. While these types of shapes generally denote a regular configuration, the openings could have an irregular shape, one that may combine curved and straight segments.

Figure 4A:
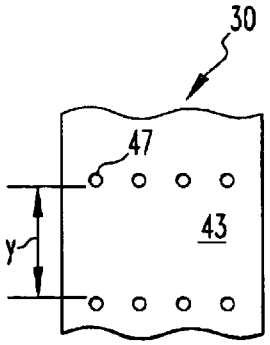
FIGS. 4*a*–4*c* shown schematic alternative configurations for the heat exchanger of FIG. 3.

In addition, the frequency of openings 47 in the channel walls 33 can also vary. The openings could be circular in shape, and spaced at regular intervals along the length or longitude of the tubing, for example, every inch, every two inches, every four inches, etc., as shown in the plan view of a tubing in FIG. 4*a*. In this Figure, the openings 47 are present in each inner wall in a transverse direction, but spaced longitudinally a distance "y".

Figure 4B:
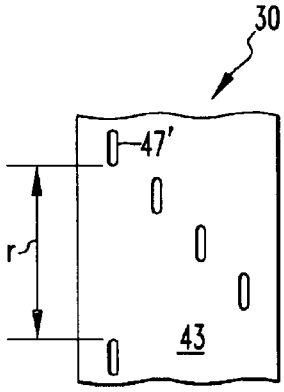
Figure 4C:
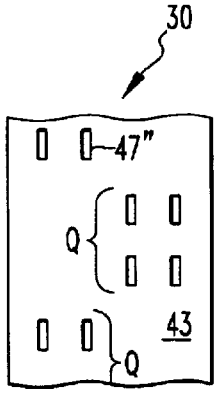

Alternatively and referring to FIG. 4*b*, oval openings 47' could be used and spaced apart so that only one opening 47' exists in a transverse direction, with the openings 47' for each channel being spaced apart a given distance "r". FIG. 4*c* shows yet another embodiment using rectangular openings 47", with two openings lying in the transverse direction, and a group of four channel openings identified as "Q" repeating in the longitudinal direction. Of course, other transverse and longitudinal spacing arrangements as well as opening shapes could be employed without departing from the scope of the invention, including even irregular spacing in both transverse and longitudinal directions.

In terms of making multivoid tubing conventionally, it is common to employ aluminum alloys and use extrusion techniques. Extrusion techniques using aluminum alloys can also be employed to make the inventive tubing 30 with the angled channel walls 33. While the walls 33 are shown with generally flat surfaces, the shape of the channel surfaces could also be modified if so desired, e.g., make the surfaces convex or concave. Of course, any other known ways to make heat exchanger tubing can be employed in connection with the invention.

Once the tubing is formed, the openings 47 can be formed by machining, drilling, stamping, cutting (mechanical, laser, etc.) or any other known ways for making an opening in a metal material such as an aluminum alloy. While a single opening is shown in the inner channel wall 33, multiple openings in the transverse direction could be formed provided that the inner wall is dimensioned to permit more than one opening.

Figure 1:
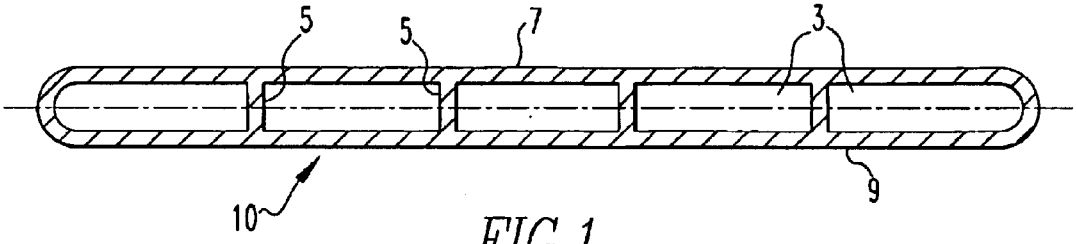
FIG.1 PRIOR ART
FIG. 1 is a cross sectional view of a prior art heat exchanger tubing.
Figure 2:
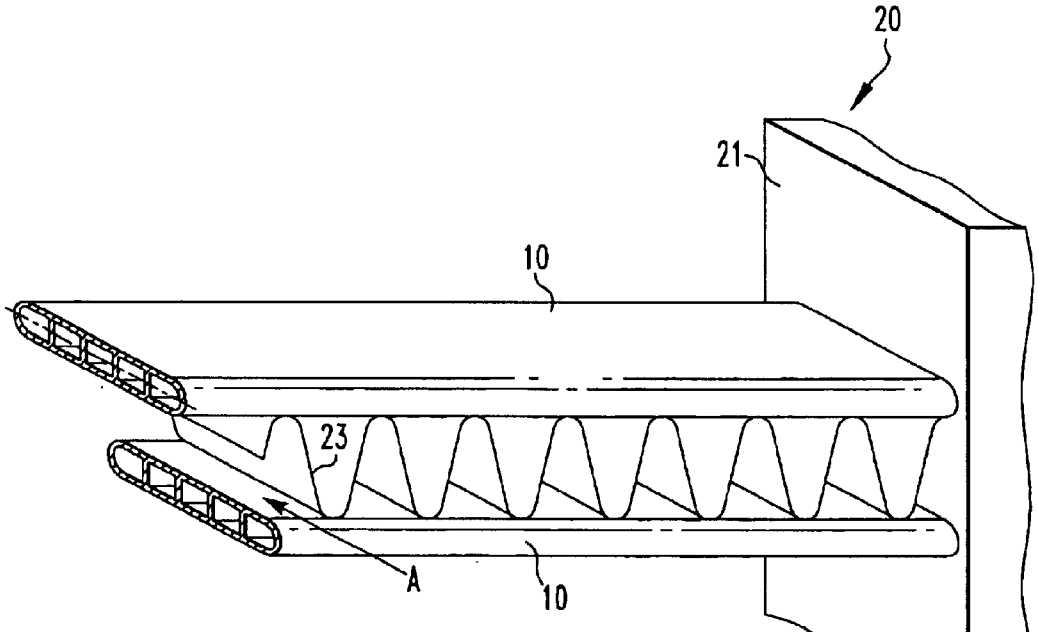
FIG.2 PRIOR ART
FIG. 2 is a schematic partial view of a prior art heat exchanger assembly using the tubing of FIG. 1.
Figure 5:
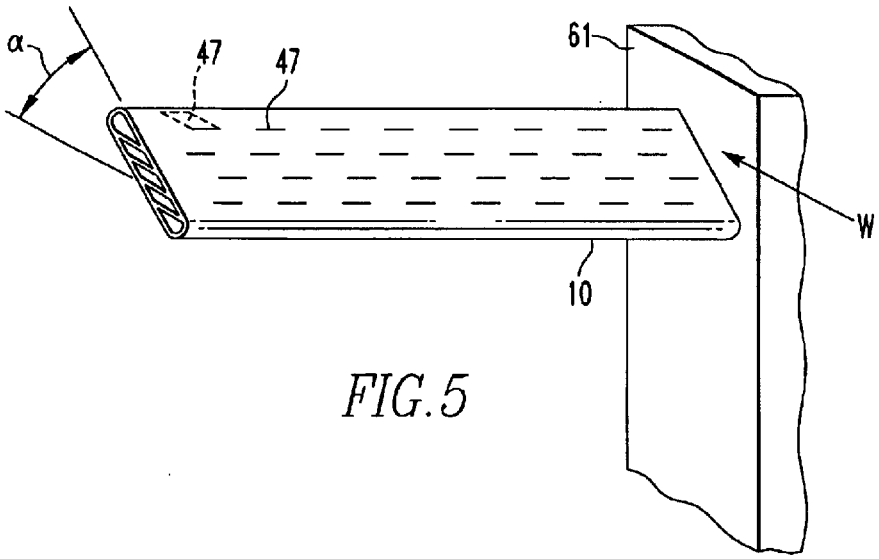
FIG. 5 is a schematic partial view of a heat exchanger assembly using the tubing of FIG. 3.
Figure 6:
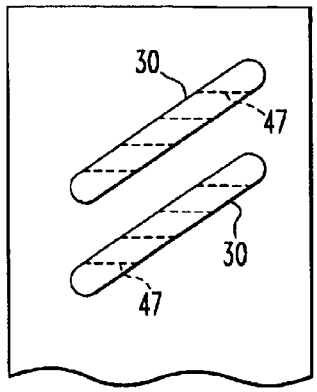
FIG. 6 shows a schematic view of the FIG. 3 tubing in an overlapped position in a heat exchanger assembly.

The presence of the openings 47, 47', 47" also permits the tubing 30 to be used in a heat exchanger assembly without the fin stock used in prior art heat exchanger assemblies. As noted above, this offers a significant savings in heat exchanger costs and manufacturing time. Referring now to FIGS. 5 and 6, a partial schematic of a heat exchanger assembly is designated by the reference numeral 60 and includes a header 61 in fluid communication with the tubing 30. The tubing 30 is attached to the header such that the center axes of the openings 47 are aligned in a direction that coincides with the expected air flow direction across the heat exchanger. In this manner, the tubing surfaces 43 and 45 will be angled with respect horizontal so that an axis of the opening 47 will align with the direction of airflow identified as "W" ("W" is generally horizontal when the headers are vertical). Put another way, the surfaces 43 and 45 are positioned at the angle $\alpha$ with respect to horizontal so that the openings 47 are aligned with the airflow "W", i.e., are generally horizontal. This tubing configuration with respect to the header allows for airflow past the tubing 30, and through the openings 47. This arrangement permits the inner walls of the openings 47 to function as a heat exchange surfaces and attain adequate heat transfer without the need for fin stock as would normally be used, see FIG. 2. By tilting the tubing so that openings 47 align with the air flow, the pressure drop across the tubing is reduced, thus providing an advantage over the high pressure drop design disclosed in the Moser et al. publication discussed above.

The assembly of FIG. 5 shows an example wherein the headers are vertical with the tubing 30 running horizontal. In instances where the headers are aligned horizontally, FIG. 5 could be rotated 90 degrees to show the disposition of the tubing 30, i.e., generally vertical when the headers are horizontal.

FIG. 6 shows the overlapping position of the tubing 30 when employed in a complete heat exchanger assembly.

Figure 7:
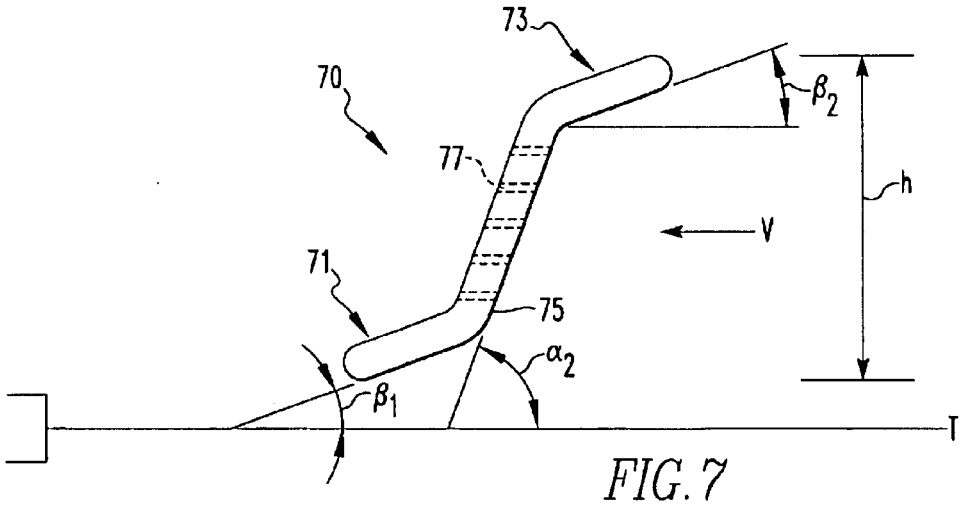
FIG. 7 shows a schematic side view of another embodiment of the inventive tubing.

Besides the tubing's ability to effectively exchange heat without the need for fin stock, the tubing could have other shapes to fit particular applications. FIG. 7 shows an exemplary tubing 70 with tubing ends 71 and 73, body portion 75, and openings 77. The tubing 70 fits in a dimension "h" with the tubing ends 71 and 73 being angled with respect to the line "T" at $\beta_1$ and $\beta_2$, respectively, wherein $\beta_2<\beta_1$. The body portion 75 is formed at an angle $\alpha_2$. The openings 77 in the inner walls of the tubing 70 are angled with respect so that the openings are still aligned with the direction of airflow "V". This design allows for the tubing to be used in applications wherein the generally flat tubing of FIG. 3 may not fit.

Figure 8:
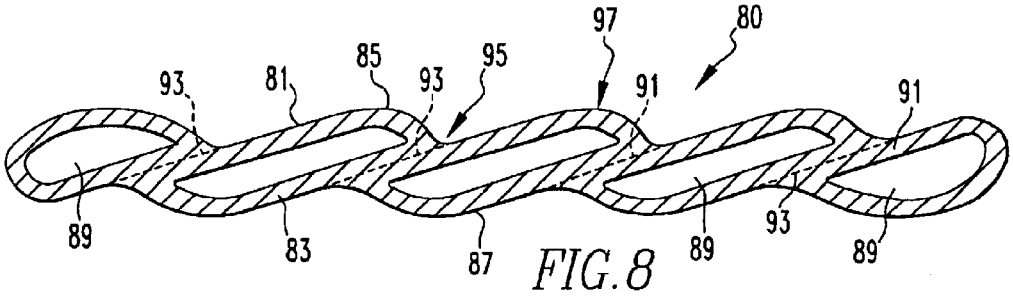
FIG. 8 shows a cross sectional view of yet another embodiment of the inventive tubing.

FIG. 8 shows another embodiment of the tubing of the invention that is designated by the reference numeral 80. The tubing 80 has opposing or top and bottom walls 81 and 83, respectively, with respective opposing surfaces 85 and 87. A number of channels 89 are disposed in the tubing, adjacent channels separated by an inner wall 91. In contrast to the flat walls 39 and 41 of FIG. 3, the opposing walls 81 and 83 are formed to give the tubing an undulating or wavy shape when viewed in cross section. The tubing 80 also has openings (as dashed lines) in the inner walls 91 that extend between the opposing surfaces 85 and 87. The openings are designated by the reference numeral 93 and correspond in function to the openings 47 as depicted in FIGS. 3–5.

The configuration of FIG. 8 offers several advantages in heat exchanger performance and manufacturing, including allowing greater flexibility in adjusting the hydraulic diameter (the openings created by the channels 89). By aligning the openings 93 with the troughs 95 in the walls 81 and 83, the length of each opening to be formed in the walls 91 by machining, cutting or the like is reduced. At the same time, aligning the crests 97 of the walls with the channels 89 provides an increased surface cross-sectional area of the channel 89, thus enhancing heat transfer. Further, the inner channel wall thickness can be increased to improve the strength characteristics of the tubing.

While an undulating or sinusoidal tubing is depicted in FIG. 8, other non-flat shapes could be employed without departing from the invention. For example, more angular and stepped opposing walls could be employed in place of the illustrated wavy or curved ones. Alternatively or in addition, projections or enhancements such as those contemplated for the inner wall surfaces of the channels could be used in connection with the surfaces 85 and 87.

The inventive heat exchanger tubing can be used in any type of a heat exchanger, including automotive condenser applications, residential air conditioners, commercial air chillers, or the like, but may also be used in other applications as would be within the skill of the artisan. The invention is particularly advantageous for commercial air chillers. Due to the large size of the heat exchangers for these types of chillers, it is very difficult to manufacture the heat exchanger brazed fin and tube construction; the size of the exchanger requires a large brazing furnace which is not readily available.

As such, an invention has been disclosed in terms of preferred embodiments thereof which fulfill each and every one of the objects of the present invention as set forth above and provides a new and improved heat exchanger tubing as well as a heat exchanger assembly construction.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a heat exchanger comprising a pair of headers interconnected by a plurality of tubing, the headers and plurality of tubing defining a plane generally perpendicular to a flow path of air passing over the plurality of tubing for heat exchange, each tubing having a plurality of channels to direct fluid from one header to another header, adjacent channels in each tubing separated by an inner wall, the improvement comprising the inner wall being angled with respect to top and bottom surfaces of the tubing, the tubing having a plurality of openings, each opening extending between opposing surfaces of the tubing and through the inner wall, the plurality of tubing arranged with respect to the pair of headers so that the openings in each tubing are arranged to be generally perpendicular to the plane to allow air directed at the heat exchanger to pass through the openings for heat exchange, wherein the tubing is arranged between the headers without fin stock in contact with the tubing.

2. The assembly of claim 1 wherein the tubing is an extruded tubing made from an aluminum alloy.

3. The assembly of claim 1 wherein each opening has a regular or irregular cross section.

4. The assembly of claim 1 wherein the tubing has a plurality of channels and a plurality of inner walls.

5. The assembly of claim 1 wherein the inner wall has longitudinally spaced apart opening therethrough.

6. The assembly of claim 4 wherein a number of the openings in the inner walls are transversely aligned.

7. The assembly of claim 1 wherein the angle ranges between about 2 and 88 degrees.

8. The assembly of claim 1 wherein the tubing has a regular or irregular cross section.

9. The assembly of claim 1 wherein the openings have a cross sectional shape selected from the group consisting of circular, square, oval, hexagonal, and rectangular.

10. The assembly of claim 8 wherein tubing ends are angled with respect to a tubing body disposed between the tubing ends.

11. The assembly of claim 8 wherein, when viewed in cross section, the tubing has flat top and bottom surfaces or top and bottom surfaces which are not flat.

12. In a multivoid heat exchanger tube having a plurality of channels extending along a length of the tubing, adjacent channels separated by an inner channel wall, the improvement comprising the inner channel wall being angled with respect to top and bottom surfaces of the tubing and wherein the tubing has a plurality of openings, each opening extending between opposing surfaces of the tubing and through the inner channel wall.

13. The heat exchanger tubing of claim 12 wherein the tubing has a plurality of channels and a plurality of inner walls.

14. The heat exchanger tubing of claim 12 wherein each opening has a regular cross section, an irregular cross section, or combination thereof.

15. The heat exchanger tubing of claim 12 wherein the inner wall has longitudinally spaced apart openings therethrough.

16. The heat exchanger tubing of claim 13 wherein a number of the openings in the inner walls are transversely aligned.

17. The heat exchanger tubing of claim 12 wherein the tubing has an irregular or regular cross sectional shape.

18. The heat exchanger tubing of claim 12 wherein the tubing is an extruded tubing made from an aluminum alloy.

19. The heat exchanger tubing of claim 12 wherein the angle ranges between about 2 and 88 degrees.

20. The tubing of claim 12 wherein the openings have a cross sectional shape selected from the group consisting of circular, square, oval, hexagonal, and rectangular.

21. The tubing of claim 17 wherein tubing ends are angled with respect to a tubing body disposed between the tubing ends.

22. The heat exchanger tubing of claim 17 wherein, when viewed in cross section, the tubing has flat top and bottom surfaces or top and bottom surfaces which are not flat.

* * * * *